United States Patent [19]

Taga

[11] Patent Number: 4,818,215

[45] Date of Patent: Apr. 4, 1989

[54] THERMALLY COLOR-CHANGING CANDLEHOLDER

[75] Inventor: Hideji Taga, Aichi, Japan

[73] Assignee: Pilot Ink Co., Ltd., Nagoya, Japan

[21] Appl. No.: 169,243

[22] Filed: Mar. 16, 1988

[30] Foreign Application Priority Data

Mar. 23, 1987 [JP] Japan ..... 62-42342[U]

[51] Int. Cl.[4] ..... F23Q 2/32

[52] U.S. Cl. ..... 431/126; 431/289; 431/291

[58] Field of Search ..... 431/126, 289, 291

[56] References Cited

U.S. PATENT DOCUMENTS 3,286,492 11/1966 Frazier ..... 431/291

4,028,118 6/1977 Nakasuji et al. ..... 106/21

4,720,301 1/1988 Kito et al. ..... 503/213

FOREIGN PATENT DOCUMENTS 851609 10/1960 United Kingdom ..... 431/291

*Primary Examiner*—Carroll B. Dority, Jr.

*Attorney, Agent, or Firm*—Sughrue, Mion, Zinn, Macpeak and Seas

[57] ABSTRACT

A candleholder having an improved ornamentation effect. A hollow shell, shaped in the form of an animal, fruit, building, etc., is heated by a candle positioned in its internal cavity. At least a portion of the shell is covered with a thermally color-changing material formed in a desired pattern. When the shell is heated by burning a candle, the pattern seen by the view thus changes.

7 Claims, 1 Drawing Sheet

THERMALLY COLOR-CHANGING CANDLEHOLDER

BACKGROUND OF THE INVENTION

The present invention relates to a decorative candleholder.

Most conventional candleholders basically are functional in design, giving insufficient attention to their decorative effect. It is therefore desired to provide a candleholder which is more decorative in design, more pleasing and interesting to view and use than standard candleholders, and which is more suitable as a gift or novelty item.

SUMMARY OF THE INVENTION

Accordingly an object of the present invention is to provide a candleholder having an improved decorative effect.

It is a further object of the invention to provide such a candleholder which can be modeled in any desired shape or pattern, for example, in the shape of an animal, flower, fruit or building.

In satisfaction of the above and other objects, the invention provides a candleholder having a color which changes with temperature. By the change in temperature, a pattern which is invisible at ordinary room temperature is made visible, or the color of a visible pattern changed.

More specifically, in accordance with the invention, there is provided a candleholder having a shell defining a hollow inner chamber. A candle is mounted in the hollow inner chamber in an upright position. An opening is formed in the shell to allow insertion and removal of the candle, lighting and extinction of the candle, and air flow to the burning candle. A thermally color-changing layer is provided on at least part of the outer surface of the shell, the color of which changes as it is heated by the candle.

DESCRIPTION OF THE PREFERRED EMBODIMENTS

Preferred embodiments of the invention will now be described with referenced to the attached drawings.

A first embodiment of the invention will be described with reference to FIGS. 1 and 2.

Figure 1:
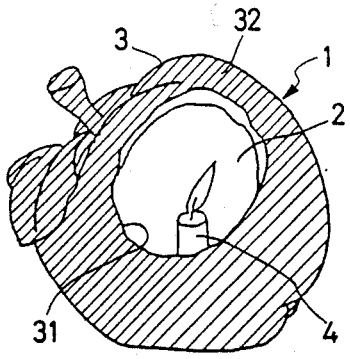
FIGS. 1 and 3 are perspective views of respective first and second embodiments of a candleholder of the invention.

As shown in FIG. 1, the candleholder 1 of the first embodiment includes a shell 3 having a hollow interior chamber 2. In this example, the shell 3 is shaped in the form of an apple. Other suggested patterns are those of an animal, flower, fruit, vegetable, tree, electric light bulb, bell, Santa Claus, and a building. The hollow interior chamber 2 is of sufficient dimensions to accommodate a candle mounted in the upright position. An opening 31 is formed in the shell 3 to allow for the insertion and removal of the candle, lighting and extinction of the candle, and to provide an air flow to the burning candle.

A thermally color-changing layer 32 is provided o at least part of the outer surface of the shell 3. Thus, as the shell is heated by the burning of the candle 4, the outer surface of the candleholder 1 changes color.

The shell 3 may be fabricated from any of a variety of known materials, for example, ceramics, glass, enameled ware, and metal.

The thermally color-changing layer 32 may be formed over the outer surface of the shell 3 by coating, spraying, dipping, marking, or the like. Otherwise, the thermally color-changing layer 32 may be formed on a separate sheet of material and the sheet adhered to the outer surface of the shell 3 or tightly wound thereon.

It is preferable for the thermally color-changing layer 32 to be formed of a color-reversible material so that the candleholder 1 ca be used repeatedly.

It is especially effective if the thermally color-changing layer 32 is employed in combination with a non-color-changing layer of either a matching or contrasting color or tone to form a decorative figure or pattern. The two layers may be formed in an overlapped state or placed side by side. If the thermally color-changing layer 32 is of the same color as the other layer at normal room temperature, a pattern defined by the thermally color-changing layer 32 can be made to appear when heated by the candle. For example, the thermally color-changing layer 32 can be arranged in the form of a message which appears only when the candle is burned.

Preferably, the thermally color-changing material 32 changes color at a temperature to which the shell 3 is heated by the burning of the candle 4, for instance, in a range of 30° to 85° C.

The thermally color-changing layer 32 is formed with a thermally color-changing pigment. Examples of such materials include a three-component thermally color-changing pigment composed of a coloring organic compound having electron donor characteristics, a developer for developing the organic compound, and a color-changing temperature modifier for varying the temperature at which the coloring reaction takes place between the organic compound and the developer for determining the color at which the color change takes place. Also, it is possible to employ a pigment of reversible thermally color-changing characteristics in the form of a resin solid solution of fine particles of the above-mentioned components. Specifically, thermally color-changing materials as described in commonly assigned U.S. Pat. No. 4,028,118 and U.S. Pat No.. 4,720,301 can be employed in the present invention.

The above materials exhibit sharp thermally color-changing characteristics at various temperatures. It is thus possible to provide a thermally color-changing layer which changes between different colors at different temperatures by suitably combining such materials. It is possible also to achieve other color combinations by the addition of standard dyes or pigments. Fluorescent pigments may also be used.

The candleholder of the present invention may be used in combination with a marker. The marker is used to freely paint figures such as a message, a picture, etc. on the thermally color-changing layer 32 so that the figures are made visible after the thermally color-changing layer 32 is changed in colors, and it is effective that the figures formed by the marker has substantially the same color as that of the thermally color-changing layer 32 at an ordinary temperature or a light color in comparison with the latter.

EXAMPLES

Example (1)

Figure 2:
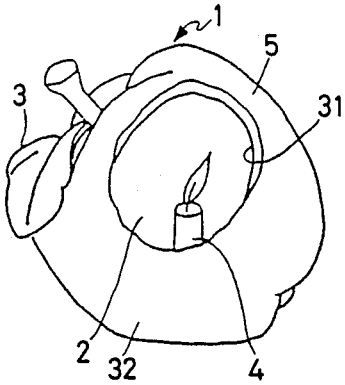
FIGS. 2 and 4 are views similar to FIGS. 1 and 3 but showing the respective candleholders after they have been changed in color.

A porcelain apple-shaped body 3 having a hollow interior portion 2 and an opening 31 was formed as shown in FIGS. 1 and 2.

After a non-color-changing layer 5 was formed on the outer surface of the shell 3 with a yellow pigment, and the leaf portion was colored green with a similar green pigment. A reversible thermally color-changing layer 32 was formed over the fruit portion using a reversible thermally color-changing ink having a color-changing point at 50° C. and which was red a temperatures below 50° C. and transparent above that temperature. Thus, a red-colored fruit with a green leaf portion was seen at temperatures lower than 50° C. (including of course ordinary room temperatures), while the red color disappeared when the temperature exceeded 50° C. thereby showing a yellow apple.

The position at which the candle is mounted, and the position, shape and size of the opening portion should be such that the temperature of the outer surface of the shell 3 is not so high as would burn the fingers of the user.

Example (2)

Figure 3:
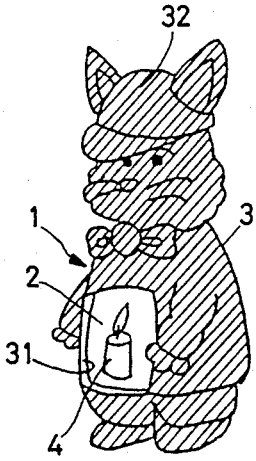
Figure 4:
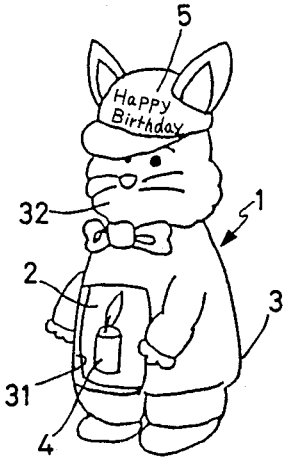

A porcelain dog-shaped shell 3 was formed as shown in FIGS. 3 and 4. An opening 31 is formed in the side and the head has a cap formed thereon.

A white-colored layer was formed on the outer surface of the shell 3 using a white pigment ink. The words "HAPPY BIRTHDAY" were painted on the cap using an orange non-color-changing pigment ink. The body portion was then covered with a thermally color-changing layer 32 which was brown at room temperature and which became transparent upon heating to about 55° C., and the cap was covered by a similar layer but of red color. Thus, at room temperature, only the brown body and red cap were seen, while when the object was heating by burning a candle, the white color and the orange "HAPPY BIRTHDAY" message became visible. Of course, when the candle was extinguished, the brown and red colors returned.

Thus, in the above examples, the external appearance of the candleholder changes greatly when a candle is burned. In Example (1), a red apple with a green leaf are changed to a yellow apple, while in Example (2), a brown dog with a red cap was changed into a white dog with the words "HAPPY BIRTHDAY" in orange on its cap. The decorative effect attained with the invention is therefore quite good, making the value of articles so made high. Such articles are quite suitable for use as party decorations, gifts and the like.

What is claimed is:

1. A candleholder comprising: a shell shaped to simulate an external appearance of a predetermined object, said shell having a hollow interior chamber for accommodating a candle and an opening communicating with said chamber; and a layer of a thermally color-changing material formed on at least a portion of an outer surface of said shell.

2. The candleholder of claim 1, wherein said shell is made of a material selected from the group consisting of ceramics, glass enameled ware and metal.

3. The candleholder of claim 1, further comprising a layer of thermally non-color-changing material provided on at least portions of said outer surface of said shell.

4. The candleholder of claim 3, wherein at least a portion of said thermally non-color-changing material is formed under said layer of thermally color-changing material.

5. The candleholder of claim wherein at least a portion of said thermally non-color-changing material is formed side by side with respect to at least a portion of said thermally color-changing layer.

6. The candleholder of claim 3, wherein at least a portion of one of said thermally color-changing material and said thermally non-color-changing material is in the form of a message which appears when said thermally color-changing layer is heated.

7. The candleholder of claim 3, wherein at least a portion of said thermally color-changing layer and said thermally non-color-changing layer are of the same color at normal room temperature and of different colors when said shell is heated by burning a candle therein.

* * * * *